US005853536A

United States Patent [19]

Hornsey et al.

[11] Patent Number: 5,853,536

[45] Date of Patent: Dec. 29, 1998

[54] METHOD FOR OZONE BLEACHING OF CELLULOSIC PULP AT LOW CONSISTENCY

[75] Inventors: Derek Hornsey, Beaconsfield; John Ayton, Delta; Michel Epiney, Duvernay; Gordon Homer, West Vancouver, all of Canada

[73] Assignee: Canadian Liquid Air Ltd./Air Liquide Canada LTEE, Quebec, Canada

[21] Appl. No.: 718,706

[22] Filed: Sep. 27, 1996

Related U.S. Application Data

[60] Provisional application No. 60/004,417 Sep. 28, 1995.

[51] Int. Cl.[6] ..... D21C 9/14; D21C 9/153

[52] U.S. Cl. ..... 162/65; 162/88

[58] Field of Search ..... 162/65.82, 88.83, 162/89.77, 52

[56] References Cited

U.S. PATENT DOCUMENTS

| | | | |
|---|---|---|---|
| 4,198,266 | 4/1980 | Kirk et al. | 162/65 |
| 4,959,124 | 9/1990 | Tsai | 162/65 |

FOREIGN PATENT DOCUMENTS

| | | | |
|---|---|---|---|
| 1324879 | 12/1993 | Canada . | |
| WO90/13705 | 11/1990 | WIPO . | |
| 92/17639 | 10/1992 | WIPO | 162/65 |

OTHER PUBLICATIONS

Liebergott et al, "A Survey of the Use of Ozone in Bleaching Pulps, Part 1", *Ozone Bleaching*, TAPPI Journal, Jan. 1992, pp. 145–151.

Liebergott et al, "A Survey of the Use of Ozone in Bleaching Pulps, Part 2", *Ozone Bleaching*, TAPPI Journal, Feb. 1992, pp. 117–124.

Chirat et al, "Other Ways to Use Ozone in a Bleaching Sequence," TAPPI Proceedings, 1995 Pulping Conferrnce, pp. 415–419.

Lachenal et al, "Improvement in the Ozone Bleaching of Kraft Pulps," *International Bleaching Conference*, Stockholm, Sweden 1991.

*Primary Examiner*—Steven Alvo

*Attorney, Agent, or Firm*—Burns, Doane, Swecker & Mathis, L.L.P.

[57] ABSTRACT

A method of bleaching a pulp at low consistency employs chlorine dioxide and/or chlorine, to partially bleach the pulp. The aqueous partially bleached pulp flows along a sinuous flow path providing a high ratio of flow path of aqueous pulp to length of effective travel of the aqueous pulp. Ozone is introduced to the aqueous pulp at spaced apart locations in the flow path so that a low partial pressure of ozone is established in the flow path which favors chemical oxidation of the lignin and low chemical attack on cellulose. In this way effective bleaching is achieved with reduced use of chlorine or chlorine dioxide and reduced production of chlorinated compounds.

10 Claims, 2 Drawing Sheets

METHOD FOR OZONE BLEACHING OF CELLULOSIC PULP AT LOW CONSISTENCY

CROSS-REFERENCE TO RELATED APPLICATION

This application claims the benefit of the pending U.S. Provisional application Ser. No. 60/004,417 filed Sep. 28, 1995.

BACKGROUND OF THE INVENTION

1. Field of the Invention

This invention relates to a method of bleaching an aqueous cellulosic pulp and a bleaching installation, more especially the invention is concerned with replacement of part of a chlorine bleaching stage, for example, a chlorine, chlorine dioxide, chlorine dioxide/chlorine or chlorine/chlorine dioxide bleaching stage with an ozone bleaching stage as a post stage.

2. Description of Prior Art

In the bleaching of cellulosic pulps derived from Kraft digestion or sulfite digestion, it is accepted practice to use chlorine dioxide (D), chlorine (C) or a mixture of chlorine dioxide and chlorine ($D_c$ or $C_d$).

In some bleaching sequences a C, D, $D_c$, $C_d$ is used initially and a subsequent bleaching stage may use one or more of oxygen (O), ozone (z), hydrogen peroxide (P) or chlorine dioxide (D).

U.S. Pat. No. 4,959,124 describes a [D] [Z] [E] [D] sequence for bleaching Kraft pulp in which D-stage was carried out at a pulp consistency of 10% and the Z stage at a pulp consistency of 1%. The conditions described are laboratory conditions.

In a paper presented at the 1991 International Bleaching Conference in Stockholm, Sweden, Lachenal et al presented a paper "Improvement in the Ozone Bleaching of Kraft Pulps", that showed that the sequence D.Z. produced a stronger pulp than the sequence Z.D. Again these were laboratory tests in which the D bleaching was carried out at a consistency of 3.5% and the Z stage 40%.

It is generally considered to be desirable, either for environmental reasons or political reasons in view of public conceptions or concerns as to hazards associated with use of chlorine or chlorine dioxide, to reduce the amount of chlorine or chlorine dioxide in pulp bleaching operations.

It would be particularly advantageous to replace all or a part of the chlorine or chlorine dioxide with a more benign non-chlorine bleaching agent such as ozone.

The sequences [Z] [D] and [Z] [D/C] have been found to produce more degradation of cellulose and inferior viscosity of the bleached pulp as compared to the sequences [D] [Z] and [D/C] [Z].

Consequently it is preferable to employ ozone (Z) subsequent to [D] or [$D_c$]. Commercially successful processes are available employing ozone (Z) subsequent to [D] or [$D_c$], however, these are for medium consistency pulps or high consistency pulps. Medium consistency pulps have a pulp content of about 8 to 14%, by weight, and high consistency pulps have a pulp content of 25 to 45%, by weight. No commercial process is available for ozone bleaching of a pulp at low consistency previously bleached with [D] or [$D_c$]. Pulps at low consistency have a pulp content of only 2 to 5%, by weight, which means that large liquid volumes have to be handled while providing effective exposure of the pulp to the ozone for reaction.

Additionally there is the difficulty in controlling exposure of the pulp to the ozone, in large liquid volumes, to achieve chemical attack of the lignin rather than the cellulose, by the ozone.

Canadian Patent 1,324,879 describes a pipeline reactor for reacting a gas of low water solubility, specifically oxygen, with a substance in an aqueous medium.

Ozone is relatively soluble in water, being generally several times more soluble in water than oxygen.

SUMMARY OF THE INVENTION

It is an object of this invention to provide a method of bleaching an aqueous cellulosic pulp at low consistency.

It is a particular object of the invention to replace part of a chlorine dioxide, chlorine or chlorine dioxide/chlorine or chlorine/chlorine dioxide bleaching step by an ozone bleaching step.

It is a further object of the invention to provide a bleaching installation.

In accordance with one aspect of the invention there is provided a method of bleaching an aqueous cellulosic pulp at low consistency comprising: (i) exposing an aqueous cellulosic pulp at low consistency to a bleaching with at least one of chlorine dioxide and chlorine to effect partial bleaching of the pulp, (ii) flowing aqueous partially bleached cellulosic pulp from step (i) along a flow line effective to provide a high ratio of flow path of aqueous pulp to length of effective travel of the aqueous pulp, (iii) introducing ozone under pressure into the aqueous pulp in a total amount effective to further bleach the pulp, the ozone being injected into the flow path through a plurality of spaced apart injection ports, the ozone injected at each port being a fraction of said total amount, the fraction of ozone injected at each port and the spacing of the ports being such that a low partial pressure of ozone is established in the flow path effective for chemical oxidation of lignin in the pulp by the ozone with low chemical attack on cellulose in the pulp by the ozone.

In accordance with another aspect of the invention there is provided an installation for bleaching an aqueous pulp at low consistency comprising: a) a vessel for partial bleaching of an aqueous pulp at low consistency with at least one of chlorine and chlorine dioxide, the vessel having an inlet for pulp and an outlet for partially bleached pulp, b) a tortuous pipeline having an inlet line communicating with an upstream portion of the pipeline and an outlet line communicating with a downstream portion of the pipeline, the pipeline being effective to provide a high ratio of flow path of aqueous pulp to length of effective travel of aqueous pulp, c) a plurality of spaced apart gas injection ports in said pipeline, and d) a gas line in flow communication with each of said injector ports, said gas line being in flow communication with an ozone generator.

DESCRIPTION OF PREFERRED EMBODIMENTS

Figure 1:
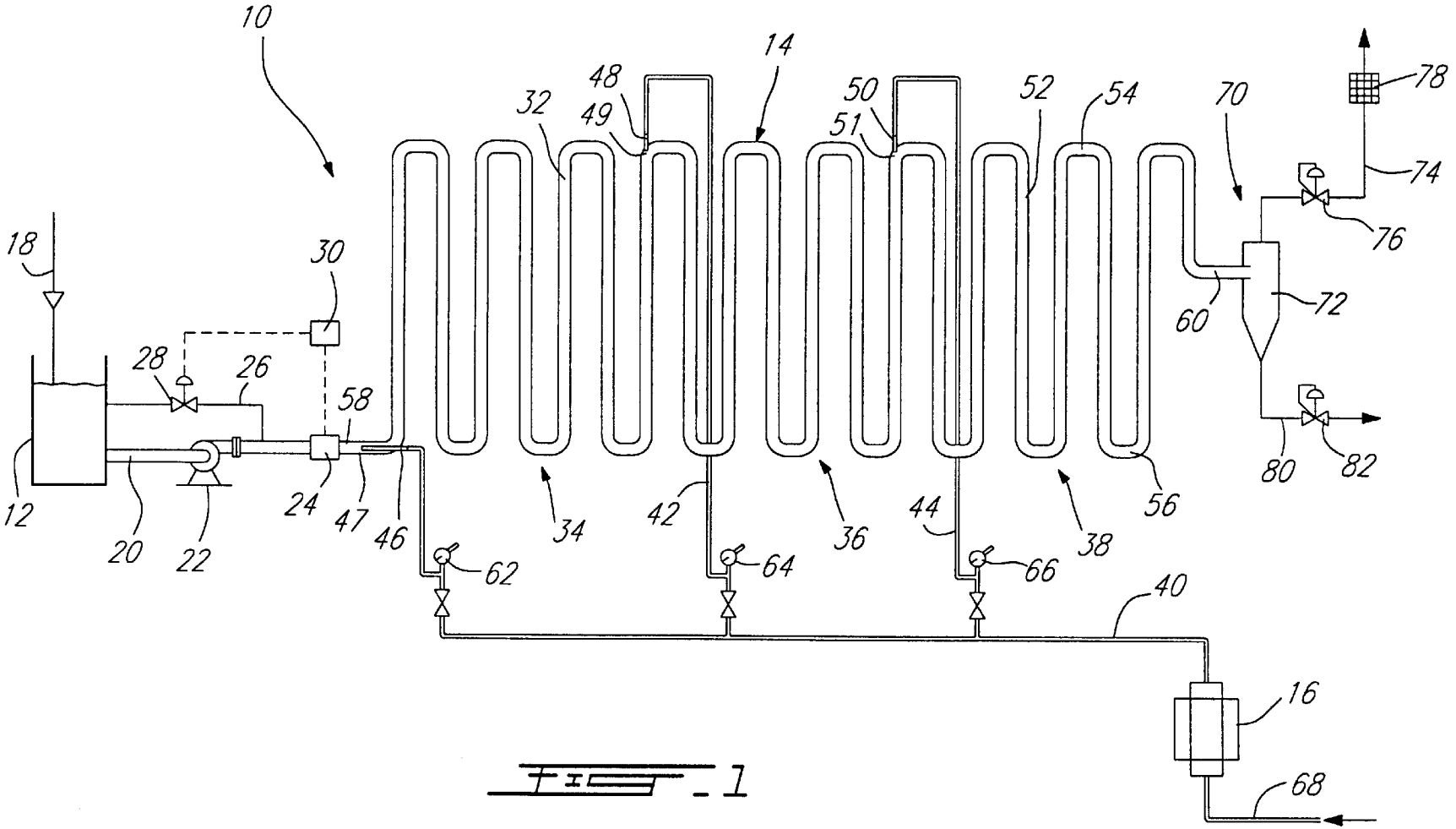
FIG. 1 is a schematic representation of an installation for carrying out the method of the invention.

Cellulosic pulps at low consistency for use in this invention are, in particular, aqueous Kraft pulps derived from a Kraft pulping operation, or cellulosic pulps derived from a sulfite pulping operation or from an alcohol pulping; such pulps having a consistency of 2 to 5%, usually 3 to 5%, by weight.

The pulps may be low consistency pulps or high or medium consistency pulps diluted to a low consistency for the ozone bleaching.

In a first step, in the method of the invention, the aqueous pulp at low consistency is bleached with chlorine bleaching chemical, more especially with chlorine dioxide (D) or chlorine (C), or both chlorine dioxide and chlorine ($D_c$) or ($C_d$), but or with the exposure consuming less of the chlorine bleaching chemical than required to complete a desired bleaching of the pulp. The chlorine bleaching chemical may be in a gaseous phase or in aqueous solution or both.

In this way an aqueous partially bleached cellulosic pulp is produced with reduced consumption of costly chlorine bleaching chemical and lower production of chlorinated organic compounds and thus lower AOX, thereby reducing cost of effluent treatment for removal of AOX.

In a preferred embodiment the pulp is a Kraft pulp having a consistency ranging from about 2 to about 5% and the first bleaching step is carried out with chlorine dioxide at an acid pH, suitably a pH ranging from about 2 to about 3, at a temperature ranging from about 20° to about 50° C. for a bleaching reaction time ranging from about 1 to about 60 minutes.

In a second step of the method of the invention the desired bleaching of the pulp is completed. In this second step the aqueous partially bleached pulp of low consistency, from the first step flows along a flow line effective to provide a flow path of a length significantly greater than the unit length of effective travel of the aqueous pulp.

In particular, the flow line may be such as to maximize the flow path of the aqueous partially bleached pulp per unit length of effective travel.

By maximizing the length of the flow path several important advantages are obtained.

First, the available time of exposure of the flowing pulp to ozone is increased, without reducing the flow rate of the aqueous pulp and this permits a more complete reaction and efficient consumption of ozone.

Secondly, the long flow path allows the total ozone requirement to be introduced at spaced apart locations in the flow path such that a fraction of the total ozone requirement is introduced at each location. In this way a low partial pressure of ozone is established in the flow path and a more uniform distribution of the ozone throughout the flow path, and these factor favor chemical attack of the lignin in the pulp rather than attack on the cellulose or cellulose components. Consequently, significantly less degradation of the cellulose occurs as compared with a single location of injection of the total ozone requirement.

Thirdly, since ozone is typically employed in admixture with oxygen, in a gas mixture which typically contains ozone in an amount ranging from about 6 to about 20%, preferably 10 to 14%, by weight, with the balance being oxygen, the introduction of the gas mixture at a plurality of spaced apart locations makes it possible to introduce the oxygen gas as fine bubbles and maintains the oxygen as fine bubbles in the flow path, so that a bubble flow condition is exhibited throughout the flow path and slug flow is avoided.

Although oxygen is relatively inactive and is not consumed in the reaction between the ozone and the pulp, formation of slugs of oxygen is undesirable since inevitably some of the ozone will be trapped in the slugs and will thus not be available for reaction with the pulp. Slugs arise from coalescence of small bubbles; by introducing fractions of the total ozone requirement at spaced locations slug formation is minimized, especially in the upstream region of the flow path where the bleaching reaction commences. In the downstream region of the flow path where the oxygen content is higher, slug formation is less problematic since the bleaching is approaching completion.

Slug formation is minimized by inducing turbulent flow conditions in the flow path and maintaining a flow pattern of aqueous pulp and gas such that a bubble flow condition is exhibited in the flow path.

The second bleaching step is suitably carried out with an ozone/oxygen gas mixture containing an amount of ozone ranging from about 6 to about 14%, by weight, more usually ranging from about 8 to about 12% by weight, the balance being oxygen.

The gas mixture is suitably introduced into the flow path at a total charge of ozone ranging from about 1 to about 10, preferably about 2 to about 6 kg/metric ton of pulp. This total charge is introduced in discrete, separate fractions through a plurality of injection ports at spaced apart locations in the flow path, so that a low partial pressure of ozone is established in the flow path.

Suitably the flow path has 2 to 5, preferably 3 to 5 injection ports at spaced locations in the flow path.

The upstream injection port is most suitably at the inlet to the flow path. If the most upstream injection port is downstream of the inlet to the flow path, the portion of the flow path upstream of the most upstream injection port will not provide a reaction zone.

The most downstream injection port should be upstream of the outlet from the flow line.

In particular the injection ports should be spaced apart in the flow path to maximize the reaction time between the ozone and the pulp lignin, while maintaining the desired low partial pressure of ozone to optimize the reaction between ozone and pulp lignin and minimize the reaction between ozone and pulp cellulose.

Suitably the aqueous pulp flows along the flow path at a hydraulic velocity ranging from about 4 to about 10 ft./sec., (about 1.2 to about 3 m/sec.) under a pressure ranging from about 100 to about 150 psig (about 6.9 to about 10.3 KPa) for a reaction time of 30 to 120 seconds. Employing these preferred parameters with 3 to 5 injection ports it is found that 90 to 99%, by weight, of the total ozone charge is consumed in the flow path, which represents efficient usage of ozone.

With reference to FIG. 1, an installation 10 includes a holding tank 12 for receiving a partially bleached aqueous pulp from a chlorine dioxide tower (not shown), a pipeline reactor 14 and an ozone generator 16.

Holding tank 12 has an inlet line 18 and an outlet line 20 having a pump 22 and a flow meter 24. A bypass or return line 26 having a control valve 28 communicates line 20 with tank 12. Flow meter 24 and control valve 28 are connected to a flow controller 32.

Pipeline reactor 14 has an inlet line 58 and an outlet line 60, an ozone main line 40 and ozone branch lines 42 and 44 terminating in injectors 46, 48 and 50 connected to the sinuous pipeline 32 at injector ports 47, 49 and 51.

An upstream zone 34 is defined in sinuous pipeline 32 between injectors 46 and 48, an intermediate zone 36 is defined in sinuous pipeline 32 between injector 48 and injector 50 and a downstream zone 38 is defined in sinuous pipeline 32 between injector 50 and outline line 60.

The zones 34, 36 and 38 of sinuous pipeline 32 are defined by a plurality of generally parallel, straight, elongate pipe portions 52, adjacent pipe portions 52 being connected by U-bend pipe portions 54 to form a sinuous flow path 56.

Flow meters 62, 64 and 66 are disposed in lines 40, 42 and 44 respectively.

Oxygen line 68 connects with ozone generator 16.

A separation unit 70 is disposed downstream of pipeline reactor 14. Separator unit 70 includes a gas/pulp separator 72 having a gas line 74 and a pulp line 80. Separator 72 is connected to pipeline reactor 14 by the outlet line 60 of pipeline reactor 14. Gas line 74 communicates with an ozone destruct unit 78, and a pressure control valve 76 is located in gas line 74 upstream of unit 78.

Pulp line 80 includes a level control valve 82.

Figure 2:
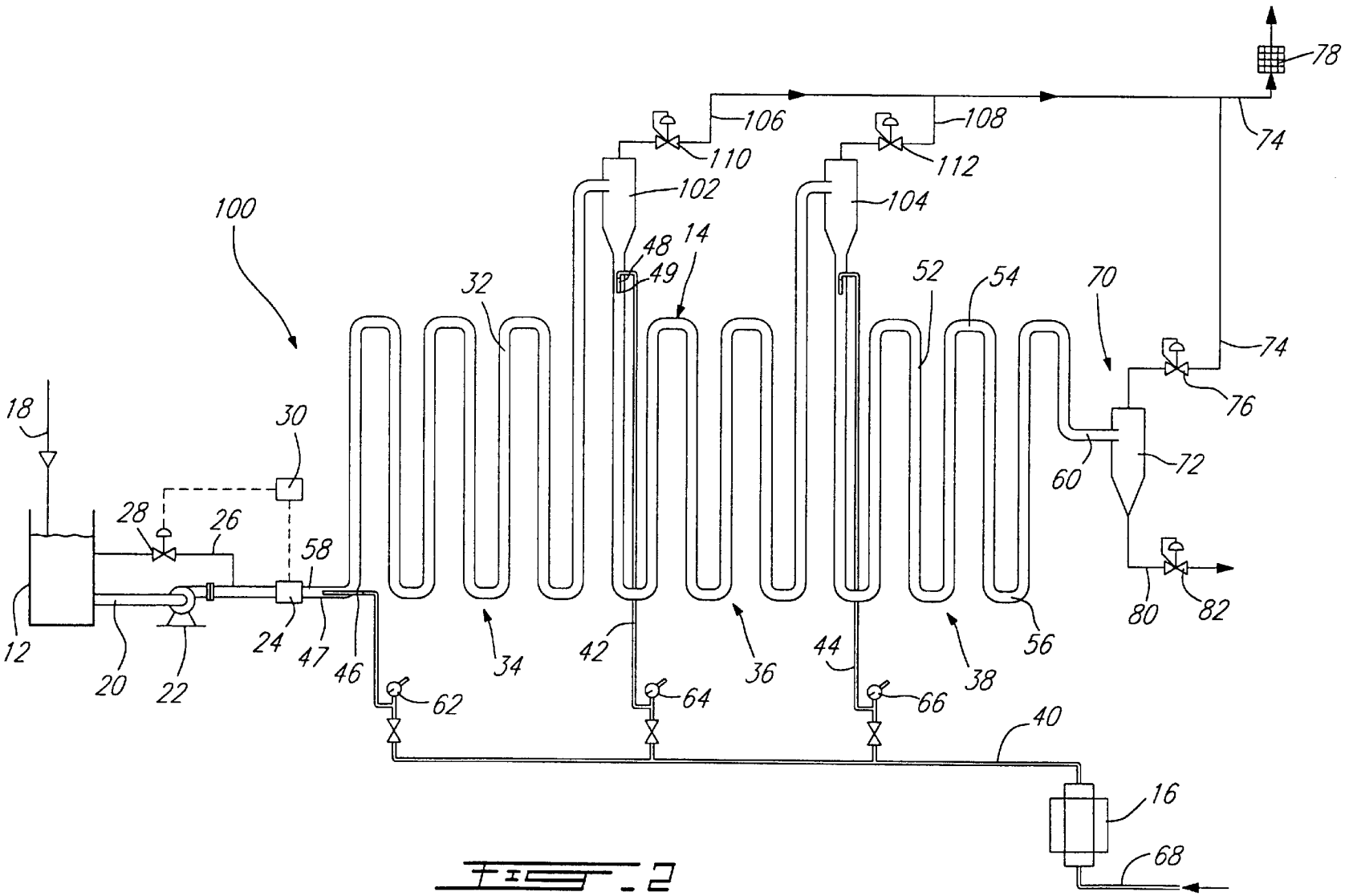
FIG. 2 is a schematic representation similar to FIG. 1 but in a different embodiment.

With further reference to FIG. 2, there is shown an installation 100 similar to that of FIG. 1, in which the same integers are employed for parts shown and described in FIG. 1.

The installation 100 differs from that of FIG. 1 by the inclusion of gas/pulp separators 102 and 104 in pipeline 32 at the downstream ends of zones 35 and 36, respectively. Injectors 48 and 50 are located immediately downstream of the gas/pulp separators 102 and 104 respectively, to maximize the contact with ozone in zones 36 and 38.

Gas discharge lines 106 and 108 convey oxygen and residual unreacted ozone from gas/pulp separators 102 and 104 respectively. Line 108 feeds into line 106 which in turn feeds into line 74 to ozone destruct unit 78. Pressure control valves 110 and 112 in line 106 and 108, respectively, reduce the pressure of the gas escaping from gas/pulp separators 102 and 104, to atmospheric pressure.

In a typical operation in accordance with the invention employing installation 10 of FIG. 1, a cellulosic pulp slurry of medium or low consistency from a Kraft or sulfite pulping process is pumped through a mixer (not shown) where a solution typically containing about 10 g/l of chlorine dioxide is added and mixed thoroughly with the pulp. This mixture is introduced into the bottom of an upflow tower (not shown) in which it gradually ascends. At the top of the tower the mixture flows through inlet line 18 to holding tank 12.

Thus the pulp in holding tank 12 has been partially bleached with chloride dioxide.

In the case of a medium consistency pulp, the pulp is then diluted to a low consistency, typically 2 to 5%, by weight.

The aqueous partially bleached pulp is pumped through outlet line 20 by pump 22 through flow meter 24 to inlet line 58 of pipe line reactor 14.

Flow controller 30 monitors the flow of the aqueous pulp at flow meter 24 and adjusts control valve 28 in bypass or return line 26 to maintain a desired flow from tank 12 to pipeline reactor 14, excess flow being returned to tank 12 by return line 26.

The pulp enters the sinuous pipe line 32 through the inlet line 58 and flows along sinuous flow path 56 defined by the elongate pipe portions 52 and the U-bend pipe portions 54.

Oxygen is fed from a source (not shown) along oxygen line 68 to ozone generator 16. Ozone is generated from the oxygen in ozone generator 16 and a mix of ozone and oxygen leaves ozone generator 16 along ozone main line 40.

Flow of ozone in main line 40 to injector 46 is controlled by a flow meter 62 to introduce a desired level of ozone in upstream zone 34. Similarly the flow of ozone from main line 40 through branch lines 42 and 44 is controlled by flow meters 64 and 66 respectively to provide a desired flow to injectors 48 and 50, so as to provide a desired level of ozone in intermediate zone 36 and downstream zone 38, respectively.

The level of ozone delivered to the zones 34, 36 and 38 is controlled to provide a low partial pressure of ozone in each of the zones 34, 36 and 38 to favor reaction between ozone and lignin rather than ozone and cellulose, in the pulp.

Advantageously the injector port 49 of injector 48 is located at a flow length from injector port 47 of injector 60 such that aqueous pulp arriving at injector port 49 in the flow path 56 has substantially consumed all of the ozone entrained during the flow of the aqueous pulp past injector port 47, so that the aqueous fluid can be replenished with a new load of ozone at injector port 49 to replenish the ozone consumed in upstream zone 34. This ozone introduced at port 49 is then substantially consumed in intermediate zone 36 so that the aqueous pulp arriving at injector port 51 can similarly be replenished with ozone from injector 50, to achieve the required low partial pressure favoring the chemical reaction between the ozone and the lignin.

This mode of introduction of the gas through the spaced apart injector ports 47, 49 and 51 is exploited in conjunction with the velocity flow of the aqueous slurry to establish a bubble flow condition of the oxygen.

Suitably the bubbles have a diameter of not more than 100 microns.

The rate of flow of the aqueous pulp in pipeline reactor 14 and the rate of flow of ozone and oxygen through injector ports 47, 49 and 51 is thus controlled in response to the flow meters 24, 62, 64 and 66, to establish a bubble flow condition and avoid or minimize a condition of slug flow.

The pulp is successively bleached in zones 34, 36 and 38 and the aqueous pulp flows together with unreacted oxygen gas and any residual unreacted ozone through outlet line 60 and into separator unit 70. The gas pulp mixture is discharged into separator 72 where gas is separated from the aqueous pulp. The gas exits separator 72 through gas line 74 and discharges through pressure control valve 76 where the pressure is reduced to atmospheric. From here the gas passes through ozone destruct unit 78 which destroys any residual ozone and oxygen is vented from unit 78.

The aqueous pulp flows from separator 72 along a pulp line 80, and through a level control valve 82 before passing to the next stage of the pulp process. The valves 76 and 82 also serve to control the pressure in pipeline reactor 14.

In the embodiment of FIG. 2, employing installation 100, the method is carried out substantially as described for installation 10 of FIG. 1, however, aqueous pulp containing oxygen and unreacted ozone passes into gas/pulp separators 102 and 104 at the downstream ends of zones 34 and 36, where the gases are separated out and discharged along lines 106 and 108; the pressure control valves 110 and 112 reduce the pressure of the discharged gases to atmospheric. The gases are fed into line 74 and thence to ozone destruct unit 78 where the ozone is converted to oxygen.

Bleeding of gases at the downstream end of zones 34 and 36 prior to injectors 48 and 50 has the advantage of lowering the oxygen content of the flowing pulp so that build-up of oxygen and slag formation by oxygen may be minimized.

The zones 34, 36 and 38 define discrete ozone reaction zones, downstream of the injection ports 46, 48 and 50, respectively.

The oxygen delivered from the ozone destruct unit 78 may be recycled to the ozone generator 16 for manufacture of fresh ozone for use in the invention, or may be employed in another stage of the pulp manufacture, for example, in oxygen delignification or an $E_o$ alkaline extraction stage.

By means of the method of the invention, 90% of the ozone charged into pipeline reactor 14 is consumed, which represents a very efficient use of the ozone.

The sinuous pipeline 32 may be disposed in a vertical plane or in a horizontal plane, however, the vertical plane is preferred in so far as this avoids accumulation of gas pockets adjacent the upper wall of the elongate pipe portions 52.

The ozone in pipeline 32 continues the bleaching of the partially bleached pulp from the chlorine dioxide stage, so as to further bleach the pulp. The resulting pulp may then pass to subsequent bleaching stages, in known manner.

It will be understood that a plurality of the pipelines may be employed separated by different bleaching stages, for example, a DZDZ sequence in which each ozone Z stage employs a pipeline as described herein.

While the invention has been described with preferred embodiments, it is to be understood that variations and modifications may be resorted to as will be apparent to those skilled in the art. Such variations and modifications are to be considered within the purview and the scope of the claims appended hereto.

We claim:

1. A method of bleaching an aqueous cellulosic pulp at low consistency comprising:

(i) exposing an aqueous cellulosic pulp at low consistency to a bleaching with at least one of chlorine and chlorine dioxide to effect partial bleaching of the pulp, (ii) flowing aqueous partially bleached cellulosic pulp from step (i) along a flow line effective to provide a high ratio of flow path of aqueous pulp to length of effective travel of the aqueous pulp, (iii) introducing ozone under pressure into said aqueous pulp in a total amount effective to further bleach the pulp, said ozone being injected into said flow path through a plurality of spaced apart injection ports, the ozone injected at each port being a fraction of said total amount, the fraction of ozone injected at each port and the spacing of the ports being such that a low partial pressure of ozone is established in said flow path, effective for chemical oxidation of lignin in the pulp by the ozone with low chemical attack of cellulose in the pulp by the ozone, and with the amount of ozone injected at the spaced apart injection ports along the flow path being a controlled amount such that the aqueous cellulosic pulp arriving at each immediate downstream port has substantially consumed all of the ozone entrained during the flow of the aqueous cellulosic pulp from each immediate upstream injection port.

2. The method according to claim 1, wherein said pulp at low consistency is derived from a Kraft pulping process.

3. The method according to claim 1, wherein said pulp at low consistency is derived from a sulfite pulping process.

4. The method according to claim 1, wherein said pulp at low consistency is derived from an alcohol pulping process.

5. The method according to claim 1, wherein said chlorine dioxide is an aqueous chlorine dioxide solution.

6. The method according to claim 1, wherein said bleaching is conducted with a mixture of chlorine dioxide and chlorine.

7. The method according to claim 1, in which said ozone introduced into said aqueous pulp is in admixture with oxygen in a gas mixture comprising ozone in an amount ranging from about 6 to about 14%, by weight, balance oxygen.

8. The method according to claim 1, wherein said gas mixture is injected at said injection ports, in the form of gas bubbles having a diameter of not more than about 100$\mu$, and maintaining a flow pattern of said aqueous pulp and said gas mixture in said flow path, such that a bubble flow condition is exhibited throughout the flow path and slug flow is avoided.

9. The method according to claim 1, wherein said total amount of ozone ranges from about 1 to about 10 kg ozone/metric ton pulp and said aqueous pulp flows along said flow path at a hydraulic velocity ranging from about 4 to about 10 ft./sec., said aqueous pulp being maintained in said flow path at a pressure ranging from about 100 to about 150 psig for a reaction time ranging from about 30 to about 120 seconds.

10. The method according to claim 1, wherein discrete ozone reaction zones are defined in said pipeline downstream of each injection port, and including separating gas from said aqueous pulp at a downstream end of each of said zones.

* * * * *